United States Patent [19]

Fenne

[11] Patent Number: 4,493,621

[45] Date of Patent: Jan. 15, 1985

[54] FUEL INJECTION PUMPING APPARATUS

[75] Inventor: Ivor Fenne, Greenford, England

[73] Assignee: Lucas Industries public limited company, Birmingham, England

[21] Appl. No.: 425,964

[22] Filed: Sep. 28, 1982

[30] Foreign Application Priority Data

Oct. 30, 1981 [GB] United Kingdom ..... 8132742

[51] Int. Cl.[3] ..... F04B 19/02; F02M 39/00

[52] U.S. Cl. ..... 417/462; 123/450; 123/516

[58] Field of Search ..... 417/206, 214, 218, 221, 417/462; 123/450, 467, 516

[56] References Cited

U.S. PATENT DOCUMENTS

| | | | |
|---|---|---|---|
| 3,433,159 | 3/1969 | Kemp | 123/450 X |
| 3,936,244 | 2/1976 | Drori | 417/462 X |
| 4,401,084 | 8/1983 | Jarrett et al. | 123/450 |

*Primary Examiner*—William L. Freeh

*Assistant Examiner*—Paul F. Neils

[57] ABSTRACT

A fuel injection pumping apparatus of the rotary distributor type has cam lobes of a special form in which following the crest of the cam lobe there is a first portion during which limited outward movement of the pumping plunger can take place to relieve pressure in the pipelines connecting the pump with the injection nozzles and this is followed by a second portion which causes slight inward movement is to close any cavities in the fuel contained within the passage of the apparatus.

2 Claims, 3 Drawing Figures

FUEL INJECTION PUMPING APPARATUS

BACKGROUND OF THE INVENTION

This invention relates to a fuel injection pumping apparatus for supplying fuel to an internal combustion engine and comprising a housing, a rotary distributor member mounted in the housing and arranged to be driven in use, in synchronism with the associated engine, a bore formed in the distributor member and a pumping plunger therein, a delivery passage in the distributor member and a plurality of outlet ports in the housing, said outlet ports in use being connected to the injection nozzles respectively of the associated engine, said outlet ports being positioned such that the delivery passage registers in turn therewith as the distributor member rotates, inlet port means in the housing, a source of fuel under pressure connected to the inlet port means, inlet passage means in the distributor member, said inlet passage means being connected to said bore, said inlet port means and said inlet passage means being arranged to allow fuel flow to said bore during at least part of the time said delivery passage is out of register with an outlet port, and cam means including a plurality of cam lobes for imparting inward movement to the plunger during part of the time the delivery passage is in register with an outlet port.

Such apparatus is well known in the art however, one problem is that the amount of fuel delivered through each outlet port can vary even though the amount of fuel supplied to the bore at each filling stroke of the apparatus is the same. This irregularity of delivery is thought to be due to pressure waves which travel up and down the pipelines connecting the outlet ports with the injection nozzles. When during the delivery stroke the crest of the cam lobe is reached, the supply of fuel to a particular nozzle ceases. The plunger is allowed to move outwardly a small amount and is then held against movement. The purpose of the outward movement is to reduce the pressure in the pipeline and at the nozzle and this allows a valve member in the nozzle to close quickly to prevent dribble of fuel from the nozzle orifices. The closure of the valve member in the nozzle results in a pressure wave which travels back towards the outlet port and into the various passages in the distributor member. The wave is reflected and travels back towards the nozzle and may be re-reflected many times. The purpose of the dwell on the trailing flank of the cam lobe is to ensure that a predetermined volume of fuel is relieved from the pipeline however, the pressure wave may not have become attenuated by the time the delivery passage moves out of register with the outlet port and in this situation the pressure in the various passages in the distributor member may be low to the extent that there could be a cavity in the fuel. Assuming that equal volumes of fuel are supplied to the bore at each filling stroke, it is clear that during the following delivery stroke less fuel will be delivered.

It is known to provide in each outlet port a so-called pressurising valve and the duty of these valves is to try to ensure that the pressure of fuel in the various passages in the distributor member at the instants at which the delivery passage moves out of register with the outlets, is substantially the same. Such valves are however expensive since they have to be carefully made to ensure that their operating characteristics are substantially the same.

SUMMARY OF THE INVENTION

The object of the present invention is to provide an apparatus of the kind specified in an improved form.

According to the invention in an apparatus of the kind specified each cam lobe comprises a leading flank extending to the crest of the lobe and a trailing flank extending from the crest of the lobe, said trailing flank including a first portion adjacent the crest which allows limited outward movement of the plunger, a second portion of substantial length and which is shaped to impart a small inward movement to the plunger and a third portion which extends to the base circle of the cam lobe, the small inward movement of the plunger due to the action of the second portion, acting to close up any cavities in the fuel contained in the passages in the distributor member without causing a significant rise in pressure.

BRIEF DESCRIPTION OF THE DRAWING

An example of a fuel injection pumping apparatus in accordance with the invention will now be described with reference to the accompanying drawings in which.

DESCRIPTION OF PREFERRED EMBODIMENT

Figure 1:
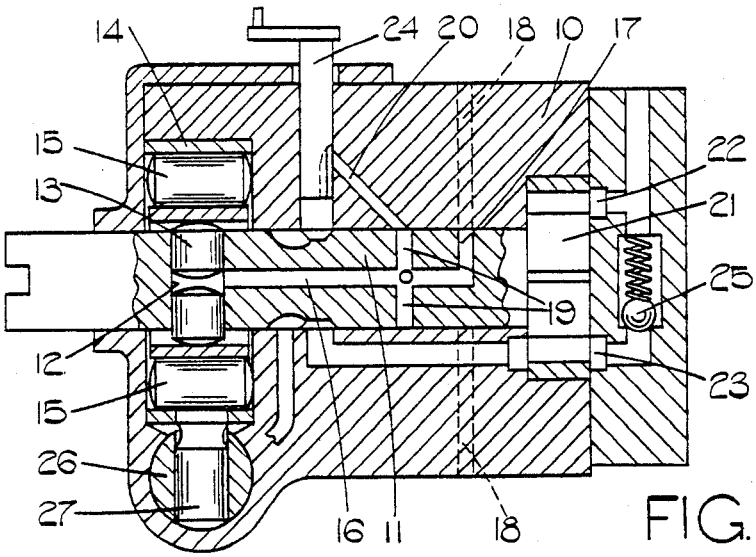
FIG. 1 is a sectional side elevation of the apparatus.

Referring to the drawings there is provided a housing 10 in which is mounted a rotary cylindrical distributor member 11 which is adapted to be driven in timed relationship with the engine with which the apparatus is associated. At one end of the distributor member there is provided a transversely extending bore 12 in which is mounted a pair of pumping plungers 13 which are arranged to be moved inwardly during an injection stroke of the apparatus, by a plurality of pairs of cam lobes formed on the internal peripheral surface of a cam ring 14 which surrounds the distributor member at this point. The cam ring is mounted within the housing and is permitted limited angular movement about the axis of rotation of the distributor member for the purpose of adjusting the timing of delivery of fuel. Interposed between the cam ring and the plungers, are rollers 15.

The bore 13 communicates with a longitudinal passage 16 formed in the distributor member and which at one point is in communication with a radially disposed delivery passage 17 which is adapted to register in turn, as the distributor member rotates with a plurality of outlet ports 18 formed in the housing. The outlet ports are connected in use, to the injection nozzles of the associated engine by respective pipelines and the communication between the delivery passage 17 and an outlet port 18 occurs whilst the plungers 13 are being moved inwardly by the cam lobes.

At another point the longitudinal passage 16 is in communication with inlet passage means which comprises a plurality of radial inlet passages 19. The housing carries inlet port means in the form of an inlet port 20 which is positioned to register with the passages 19 so that fuel can be supplied to the bore 12. Fuel is supplied to the port 20 by means of a low pressure feed pump 21 the rotary part of which is conveniently connected to the distributor member. The feed pump has a fuel inlet 22 and a fuel outlet 23. The quantity of fuel which is supplied to the inlet port is determined by an adjustable throttle member 24 and the inlet and outlet of the feed pump are interconnected by a relief valve 25. In operation, during a filling stroke fuel is supplied by way of the inlet port 20 and an inlet passage 19, to the bore 12 to effect outward movement of the plungers. The amount of fuel which is supplied through the inlet port is determined by the setting of the throttle member 24. As the distributor member rotates the inlet passage 19 moves out of register with the inlet port 20 and the delivery passage 17 moves into register with an outlet port 18. Whilst this communication is established inward movement is imparted to the plungers 13 and fuel is supplied to the respective injection nozzle. The cycle is repeated as long as the distributor member is rotated.

The angular adjustment of the cam ring 14 is effected by means of a piston 26 which is connected to the cam ring by means of a peg 27. Fuel under pressure from the output of the low pressure pump is applied to one end of the piston and effects movement of the piston against the action of a coiled spring.

Figure 2:
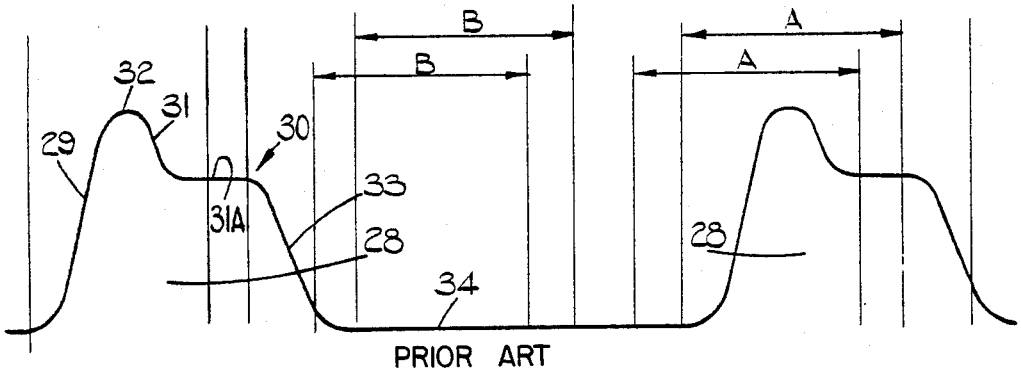
PRIOR ART FIG. 2.
FIG. 2 is a developed view of a standard form of cam lobe.

Turning now to FIG. 2, this shows a developed view of two cam lobes of known form which are referenced 28. Each cam lobe includes a leading flank 29 and a trailing flank generally indicated at 30. The roller when moved by the leading flank of the cam lobe imparts inward movement to the plunger and during such movement the delivery passage 17 is in register with an outlet 18 the period during which this registration occurs is indicated by the reference letter A and it will be noted that this is shown in two positions depending upon the position of the cam ring.

The trailing flank 30 of the cam lobe includes a first portion 31 which extends from the crest 32 of the lobe and when the roller 15 engages this portion of the trailing flank limited outward movement of the plunger can take place. Following the portion 31 there is a dwell portion 31A during which the movement of the plunger is prevented. It is whilst the plunger is under the control of the dwell portion of the lobe that the delivery passage 17 moves out of register with an outlet 18. Following the dwell portion there is a further portion 33 which extends down to the base circle of the cam this being indicated at 34. There is a period during which the passages in the distributor member are out of communication with both the inlet port 20 and an outlet 18 but towards the end of the portion 33, the inlet port 20 is opened to an inlet passage 19. The period during which this communication is established is indicated by the reference letter B and as with the period during which the delivery passage is in register with an outlet, the period is shown in two positions depending upon the position of the cam.

Figure 3:
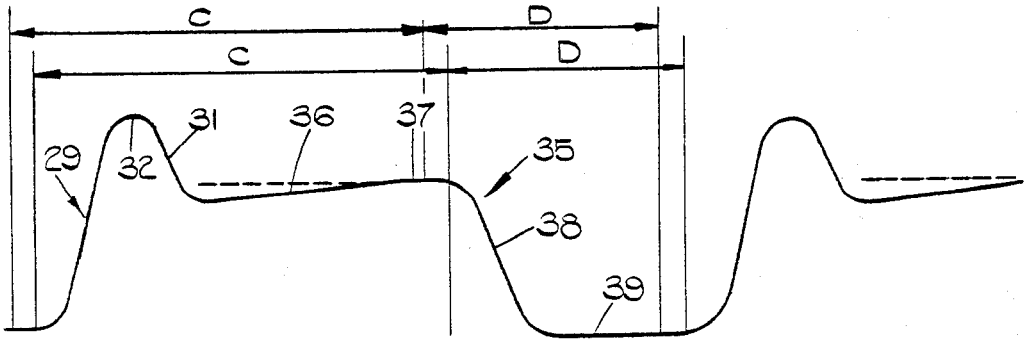
FIG. 3 is a view similar to FIG. 2 showing the modified form of cam lobe.

The modified cam profile is shown in FIG. 3 and it will immediately be seen that the configuration of the trailing flank now referenced 35, of each cam lobe is substantially altered. The leading flank 29 remains unaltered and so also does the first portion 31 of the trailing flank although it may be permitted to extend a little further towards the base circle of the cam. The main difference lies in the extent and shape of the second portion 36 of the lobe. Whereas in the case of the standard cam lobe the dwell portion 31A is such as to hold the plunger against movement, the portion 36 of the modified cam lobe is shaped to impart a small inward movement to the plunger. The difference is indicated by the dotted line in FIG. 3. The extent of inward movement is small and because the portion 36 is of substantial length, is gradual. During this movement any cavities which may be present in the fuel contained within the passages in the distributor member, will be collapsed. The rate of increase of pressure which takes place whilst the roller and plunger are controlled by the portion 36 of the trailing flank of the cam lobe is so small as not to cause any pressure waves in the passages in the distributor member and also in the pipeline connecting the outlet to the nozzle. Conveniently the portion 36 of the cam lobe terminates in a flat portion 37 during which movement of the plunger is halted and the position of the flat portion 37 corresponds with the portion 31A of the cam lobe shown in FIG. 2. Following the portion 37 is a portion 38 which extends down to the base circle 39 of the cam. It will also be noted that the period of port opening has been substantially modified as compared with the example shown in FIG. 2. The communication of the delivery passage with an outlet port has been extended and is indicated by the letter C. It will be noted that the period extends from just before the roller moves under the control of the leading flank 29 to the start of the portion 38 of the trailing flank of the lobe. It will further be noted that as soon as the registration of the delivery port with an outlet is broken, the inlet port 20 moves into register with an inlet passage 19. The communication of the inlet port 20 with an inlet passage 19 is shown by the reference letter D. It will also be noted that as soon as inlet passage 19 moves out of register with the inlet port 20, the delivery passage 17 moves into register with an outlet 18.

The modification as described above extends the time the delivery passage is open to an outlet and therefore it reduces the time which is available for filling the bore 12. It is possible to utilize the arrangement in pumps for supplying an engine with up to five cylinders but is unlikely that there would be enough time for filling of the bore in a pump intended for supplying an engine with more than five cylinders.

I claim:

1. A fuel injection pumping apparatus for supplying fuel to an internal combustion engine comprising a housing, a rotary distributor member mounted in the housing and arranged to be driven in use, in synchronism with the associated engine, a bore formed in the distributor member and a pumping plunger therein, a delivery passage in the distributor member and a plurality of outlet ports in the housing, said outlet ports in use being connected to means for injecting fuel to the associated engine, said outlet ports being positioned such that the delivery passage registers in turn therewith as the distributor member rotates, inlet port means in the housing, a source of fuel under pressure connected to the inlet port means, inlet passage means connected to said bore, said inlet port means and said inlet passage means being arranged to allow fuel flow to said bore during at least part of the time said delivery passage is out of register with an outlet port, and cam means including a plurality of cam lobes for imparting inward movement to the plunger during part of the time the delivery passage is in register with an outlet port, each cam lobe comprising a leading flank extending to the crest of the lobe and a trailing flank extending from the crest of the lobe, said trailing flank including a first portion adjacent the crest which allows limited outward movement of the plunger, a second portion means and a third portion which extends to a base circle of the cam lobe, said second portion means extending from said first portion for a length substantially greater than said first portion and being directed inwardly to a degree which is gradual as compared to the slope of said first portion for gradually imparting a small and gradual inward movement to the plunger before the delivery passage has moved out of register with an outlet port for slightly and gradually pressurizing the fuel in the pumping apparatus and the outlet ports and collapsing cavities in the fuel contained in the passages in the distributor member and in the outlet ports without causing a rise in fuel pressure in the pumping apparatus significant enough to create pressure waves in the pumping apparatus or in the outlet ports.

2. An apparatus according to claim 1 including a further portion disposed between said second and third portions of the trailing flank, said further portion acting to maintain the plunger against movement.

* * * * *